United States Patent [19]

Finken

[11] Patent Number: 4,717,918

[45] Date of Patent: Jan. 5, 1988

[54] PHASED ARRAY ANTENNA

[75] Inventor: Kenneth R. Finken, Indialantic, Fla.

[73] Assignee: Harris Corporation, Melbourne, Fla.

[21] Appl. No.: 768,597

[22] Filed: Aug. 23, 1985

[51] Int. Cl.[4] ..... H01Q 3/22

[52] U.S. Cl. ..... 342/368

[58] Field of Search ..... 343/368, 754, 771; 342/368, 369, 370, 371

[56] References Cited

U.S. PATENT DOCUMENTS

| | | | |
|---|---|---|---|
| 2,967,301 | 1/1961 | Rearwin | 343/771 |
| 3,005,168 | 10/1961 | Fye | 333/31 |
| 3,032,763 | 5/1962 | Sletten | 342/368 X |
| 3,137,856 | 6/1964 | Tashjian | 343/368 X |
| 3,697,993 | 10/1972 | Jones et al. | 343/771 X |
| 3,803,620 | 4/1974 | Young | 343/368 X |
| 4,229,746 | 10/1980 | Charlton | 343/368 |
| 4,241,352 | 12/1980 | Alspaugh et al. | 343/700 |

*Primary Examiner*—Theodore M. Blum
*Assistant Examiner*—John B. Sotomayor
*Attorney, Agent, or Firm*—John L. DeAngelis, Jr.

[57] ABSTRACT

An antenna feed network for forming and steering a phased array antenna beam. The feed network includes a plurality of dual parallel microwave transmission paths for each array element. To form and steer the beam at the correct spatial angle each pair of paths is shorted at the appropriate location to provide a time delay for the wave traversing the path. Each signal of the plurality of signals drives a different element of the antenna array with the proper phase to form and steer a beam from the array. The feed network is linear and reciprocal and can therefore be used in a transmit or receive antenna array. A ferrite circulator can be used to generate the time delayed signals on the short circuited transmission line. However, this antenna is not reciprocal and must be adjusted for either a particular receive or transmit beam position.

16 Claims, 3 Drawing Figures

PHASED ARRAY ANTENNA

FIELD OF THE INVENTION

This invention relates to a phased array antenna having a radiation pattern that can be formed and steered by mechanical movement of a shorting bar.

BACKGROUND OF THE INVENTION

An antenna array comprises a number of individual antenna elements each radiating electromagnetic energy. The composite beam emitted from a fixed antenna array can be formed and steered by controlling the phase of the signal radiated from each element. Thus, phase control allows the antenna beam to be scanned over the area of interest without physical movement of the antenna. This feature is most important when an antenna must continually scan a large directional area in a short time, such as an airport surveillance radar system.

One mechanical technique for antenna steering is described and claimed in U.S. Pat. No. 4,241,352. This patent discloses a beam scanning microwave antenna system wherein the antenna array includes a plurality of antenna elements, wherein a single point signal feed network is provided with a scan network, to couple the single point feed network to the antenna array. The scan network comprises a plurality of coupling paths between the feed network and each antenna element. The coupling paths are formed, at least in part, by conducting elements disposed in concentric circular segments A rotating directional coupler couples the feed network to the concentric circular conducting segments for varying the lengths of the respective coupling paths in accordance with the rotation of the directional coupler. Varying the path lengths varies the phase relationship between the antenna elements in a scanning fashion across the plurality of antenna elements.

A limitation of this scanning device is that the signal path is through the rotating directional coupler. This requires precise electrical control of the coupler so that there are no discontinuities or other perturbations to influence the amplitude or phase of the signal finally transmitted from each antenna element. The rotating directional coupler directly controls the amplitude of the excitation of each respective antenna element and thus the resulting composite amplitude distribution across the antenna aperture. These rotating couplers will thus be very sensitive to physical spacing between the coupled transmission lines. Because the directional coupler must rotate, it is difficult to maintain a close tolerance between the coupled lines, and the desired amplitude distribution across the face of the antenna array may be accordingly degraded. Further, this antenna array must employ a directional coupler to the phasing line. Reduced directivity in the coupler produces a loss of radiation efficiency from the antenna array. Possible reflections from backward traveling waves could also reach the radiating elements and distort the amplitude and phase distribution.

An electrical phase shifter, such as the microwave phase shifter described and claimed in U.S. Pat. No. 3,005,168, can also be used with an antenna array to provide the scanning feature. A phase shifter is associated with each antenna element such that the phase shifted beam from each element constructively interferes with the beam from every other element to produce a composite beam radiating at an angle from a line normal to the aperture. By changing the phase shift provided by each phase shifter, the beam can be scanned across the antenna aperture.

SUMMARY OF THE INVENTION

The phased array antenna of the present invention overcomes the disadvantages discussed above by shorting the microwave transmission path associated with each antenna element. The signal reflected from the short passes through an output terminal of a hybrid coupler and then to the antenna elements. The short circuit is much less critical and easier to achieve than the directional coupler discussed above. The short circuit requires a certain minimum impedance, with no phase requirements, and any variations that produce less than this minimum impedance are acceptable. The short circuit is formed by a conductive bar placed across the dual microwave transmission paths associated with each element. Movement of the shorting bar adjusts the position of all of the short circuits simultaneously and thus forms a beam and scans the angle of the beam from the antenna array. Mechanical adjustment of the shorting bar makes this invention especially appropriate for a steerable beam antenna, as compared to a rapidly scanned antenna beam.

The signal to each array element is delayed in proportion to the position of the shorting bar on the dual microwave transmission path. This is a true time delay and represents the exact amount of time necessary to form a phased array beam and position it at a given scan angle in space. Since all the microwave transmission path shorts are accomplished with the same mechanical shorting bar, the array beam can be steered to a new position in space by simply repositioning the shorting bar.

DESCRIPTION OF THE PREFERRED EMBODIMENTS

Figure 1:
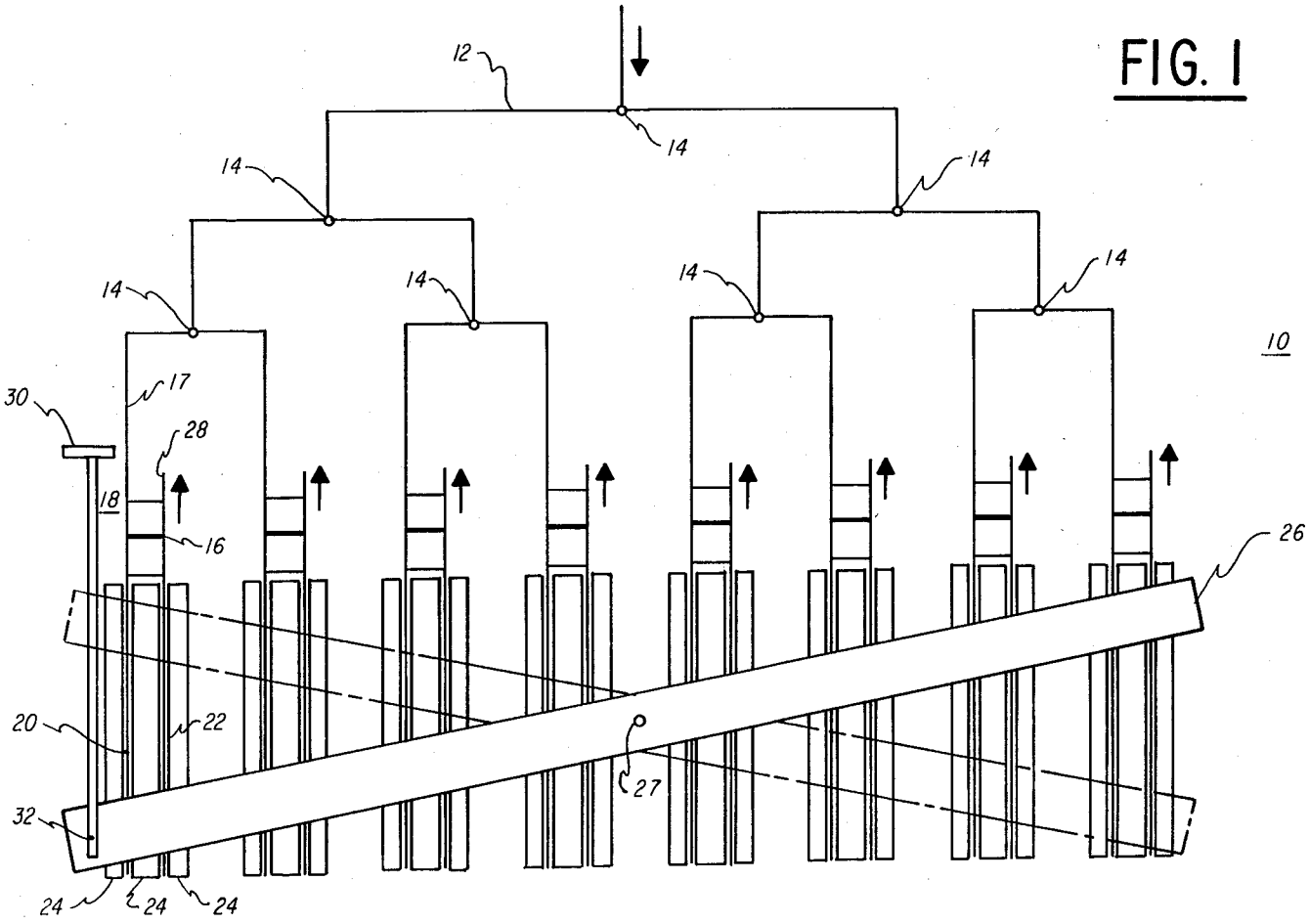
FIG. 1 is a diagrammatic illustration of an antenna feed network constructed according to the teachings of the present invention.

FIG. 1 illustrates a feed network 10 constructed according to the teachings of the present invention. For explanatory purposes, throughout the description of the preferred embodiments the feed network will be discussed as operating in a transmit configuration. In general, the receiving properties of linear reciprocal antenna systems, such as FIGS. 1 and 2 of the present invention, are identical to the transmitting properties thereof by the reciprocity theorem. (The non-reciprocal ferrite circulators, to be discussed hereinafter in conjunction with FIG. 3 require a slightly different configuration, as is well-known to those skilled in the art, for a transmit or receive antenna.) Simply stated, this theorem says that the transfer function of a reciprocal antenna is unchanged when the position of the generator and load are interchanged. See for example, *Electromagnetic Waves And Radiating Systems* published by Prentice Hall, 1962, in particular Section 10.09 thereof.

FIG. 1 illustrates the feed network 10 wherein the bold lines labeled with the reference character 12 depict a microwave transmission medium such as microstrip, with equal time delay to each of the outputs of the feed network 10. Each small open circle designated by the reference character 14 depicts a coupler for coupling the signal input thereto to at least two output lines. Such couplers are well known in the art for providing output signals having various amplitude and phase relationships to the input signal.

After traversing the microwave transmission medium 12 to the last series of couplers 14, each component of the transmitted signal is inputed to a 90 degree 3 dB hybrid directional coupler 16 via a port 17. A two section 90 degree branch line coupler is illustrated in FIG. 1, but any type of 90 degree 3 dB hybrid coupler is suitable. For explanatory purposes, note that the 90 degree 3 dB hybrid directional couplers of FIG. 1 include two upper transmission line segments, two lower transmission line segments, and three connecting segments. In the embodiment of FIG. 1 each coupler 16 operates as follows. When the signal is provided as an input to the first upper segment (via the port 17) the second upper segment is isolated, i.e., no part of the input signal appears at the isolated second upper segment. The first lower segment is aligned with the first upper segment and carries one-half of the input signal with a relative output phase of zero degrees. The second lower segment, which is aligned with the second upper segment, carries one-half of the input signal and a relative output phase of ninety degrees. The connecting segments bridge the first upper and lower segments and the second upper and lower segments.

To simplify the following discussion, it is advisable to focus on a microwave path 18 for describing the operation of the present invention. The other microwave paths of FIG. 1 operate in an identical manner. The microwave path 18 comprises the hybrid directional coupler 16 and path segments 20 and 22. As discussed above, the hybrid directional coupler 16 couples the signal input thereto to the path segments 20 and 22. The signal on path segment 20 is one-half of the input signal and a zero degrees phase relative thereto. The signal on the path segment 22 also is one-half of the input signal, but a ninety degree relative phase with respect thereto. The path segments 20 and 22 are surrounded by ground strips 24. A shorting bar 26 shorts the path segments 20 and 22 to the ground strips 24. The short circuit at the shorting bar 26 causes reflected waves to travel back toward the hybrid directional coupler 16 and to exit at a port 28. It is well known in the art that reflected signals from the path segments 20 and 22 with a 90 degree phase difference between them produces an output signal at the port 28, while the port 17 is isolated. This signal at the port 28 is time delayed relative to the signal at the port 17. This delay is caused by the transit time of the signal traveling from the 90 degree 3 dB hybrid directional coupler 16 down to the shorting bar 26 and reflected back up to the hybrid directional coupler 16. The delayed signal from each of the hybrid directional couplers 16 of FIG. 1 is fed to the corresponding antenna elements.

The important feature of the present invention is that the signal to each element of the antenna array is delayed in proportion to the position of the shorting bar 26 on the path segments 20 and 22 and the similar path segments associated with each of the other microwave paths shown in FIG. 1. The shorting bar 26 produces a true time delay wherein the time represents the exact amount of delay necessary to form a phased array antenna beam at a given position in space. Because each short of the microwave paths is accomplished with the shorting bar 26, the array beam can be formed and steered to a new position in space by simply rotating the shorting bar 26 about a pivot point 27.

Broken lines illustrate a second position for the shorting bar 26 in FIG. 1. FIG. 1 shows an adjustment rod 30, attached to the shorting bar 26 at a connection point 32; movement of the adjustment rod 30 positions the shorting bar 26. In lieu of the adjustment rod 30, the shorting bar 26 can be positioned with a lead screw and appropriate mating threads with rotation of the lead screw in the threads causing movement of the shorting bar 26. Also, in another embodiment the short circuit position can be established individually for each microwave path 18, provided that the short circuits are located to provide the necessary phase shift for the signal emitted by each antenna element. Because of the two-way path of the signals on the path segments 20 and 22 to the shorting bar 26 and then back to the hybrid coupler 16, the angular position of the shorting bar 26 must be one-half of the desired angular position from broadside of the array beam in space. But, due to the slower velocity of the wave in the dielectric of the microwave transmission medium 12, the angular position of the shorting bar 26 is actually less than the one-half position referred to above.

Several refinements can be made in the invention illustrated in FIG. 1 without diverging from the features of the present invention. For example, other geometries can be used for the microwave paths 20 and 22 at larger scan angles to more accurately provide equal path lengths from the hybrid coupler 16 to the shorting bar 26. That is, because the shorting bar 26 intersects the parallel paths 20 and 22 at an angle, the distance traveled by the wave on the path segment 20 is not precisely equal to the distance traveled by the wave on the path segment 22. Curved geometries for paths 20 and 22 can correct this difference in path lengths. Any number of microwave paths 18 can be employed depending on the desired gain of the antenna beam. Further, any 3 dB, 90 degree phase shift hybrid can be used in lieu of the two-section branch line hybrid directional coupler 16 illustrated in FIG. 1.

The ground strips 24 are shown in the embodiment of FIG. 1 as suitable means for creating a good short circuit on the path segments 20 and 22. The shorting bar 26 contacts the ground strips 24 to ensure a short path, low impedance ground. The grounding bar 26 is also made sufficiently wide to ensure a good short circuit, for example, one-quarter wavelength wide. Compared to the prior art discussed above, a short circuit is much less critical and easier to achieve than a constant impedance transmission line for carrying the signal. The short circuit must achieve only a certain minimum impedance with no phase requirements; any variations that produce an impedance less than this minimum are also acceptable. In lieu of using the shorting bar 26, which has physical contact with the microwave paths 20 and 22, a non-contracting choke-type short may be employed. In this configuration a one-quarter wavelength wide bar is placed proximate to the path segments 20 and 22 without contact being made therewith. Low impedance between the non-contacting one-quarter wavelength bar and the path segments 20 and 22 appears as a short circuit to the wave, producing the required reflections therefrom. Various other configurations are possible for the shorting bar 26, including a contacting shorting bar employing spring fingers.

It is also possible to take advantage of the reflective properties of an open circuit to provide a time-delayed signal. In such an embodiment, the open circuit position would be adjustable to provide the appropriate time delay on the path segment.

Figure 2:
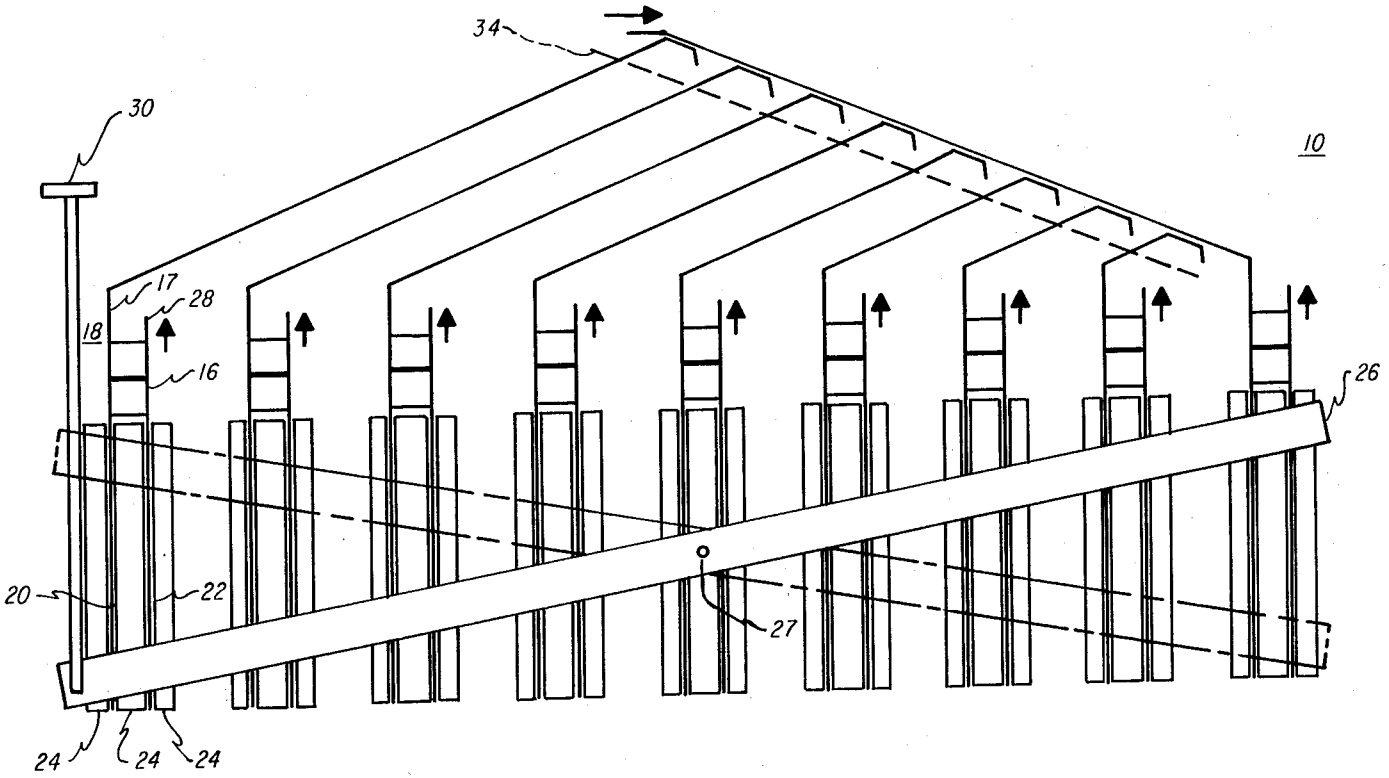
FIG. 2 is a diagrammatic illustration of a second embodiment of an antenna feed network constructed according to the teachings of the present invention.

FIG. 2 illustrates a second embodiment of the present invention. FIG. 2 shows nine microwave paths (rather than eight as shown in FIG. 1) for providing signals to nine elements of an antenna array. FIG. 2 also shows offset conductor stripline couplers for transferring the input wave to each of the microwave paths 18. As mentioned above, the microwave transmission medium can be implemented with any of the many well-known media. In the FIG. 2 embodiment, the microwave transmission medium in the area above and to the right of a dashed line 34 is implemented with stripline and the remaining medium is implemented with microstrip. The geometry of FIG. 2 provides equal time delay from the antenna input 17 to each of the 90 degree 3 dB hybrid directional couplers 16.

Figure 3:
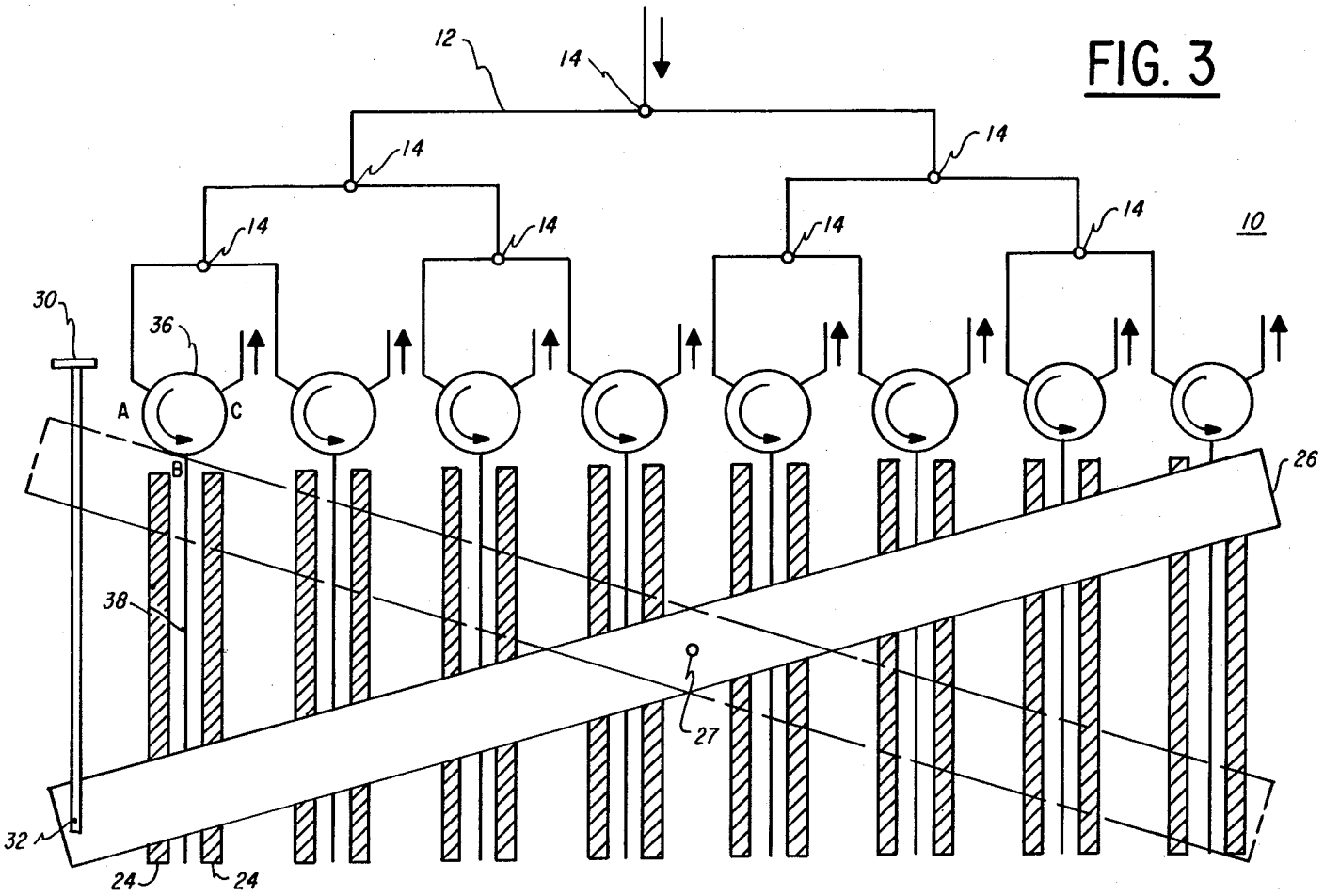
FIG. 3 is a diagrammatic illustration of a third embodiment of an antenna feed network constructed according to the teachings of the present invention.

FIG. 3 illustrates a third embodiment of the present invention wherein each of the hybrid directional couplers 16, shown in FIGS. 1 and 2, is replaced by a ferrite circulator 36. Use of the circulators 36 simplifies the feed network 10, especially with respect to the shorting bar 26.

Each of the circulators 36 is a three port ferrite device operating as follows. Referring to the circulator 36 in FIG. 3 that has three ports labeled A, B, and C, when a signal is input to port A, the output signal appears at port B, and port C is isolated. When a signal is provided as an input to port B, the output signal appears at port C and port A is isolated. Lastly, when a signal is provided as an input to port C, the output signal appears at port A, and port B is isolated. Because the circulator 36 is a ferrite device it is nonreciprocal, and therefore the receive and transmit properties of the antenna to which it is connected are different. To change the antenna from a receive to a transmit mode with the same beam position, the circulators 36 would have to be changed by turning each one over to interchange ports A and C. This would change the direction of circulation of the signal in the circulator 36.

Using a circulator 36 in lieu of a hybrid directional coupler 16 offers the advantage of having only one path segment 38 that must be shorted to ground. As shown in FIGS. 1 and 2, when the hybrid directional couplers 16 are used, two path segments 20 and 22 must be shorted to ground. This embodiment of FIG. 3 simplifies construction and makes the antenna more compact. It also eliminates the problem, discussed above, of unequal signal path lengths in the path segments 20 and 22 for large scan angles.

To summarize, the present invention describes a simple inexpensive technique for simultaneously adjusting all of the phase shifters associated with a linear phased array to generate linear phase shift at each array element to form a beam and steer the beam in a given direction in space. The device provides a true time delay so that the position of the beam is independent of frequency, and the device is equally applicable to both receive and transmit arrays.

What is claimed is:

1. A steerable beam phased array antenna comprising:

a plurality of antenna elements;

a transmission path associated with each antenna element, said transmission being adapted to carry an incident signal; and adjustable means for changing the effective length of each transmission path by establishing the termination point of each transmission path so as to form a reflected signal at the termination point, wherein said reflected signal is time delayed with respect to said incident signal as determined by the location of the termination point, to achieve forming and steering of the steerable beam phased array antenna.

2. The steerable beam phased array antenna of claim 1 wherein the transmission path includes microstrip.

3. The steerable beam phased array antenna of claim 2 wherein the microstrip is surrounded by a grounded conductor in the region of the adjustable means and wherein the adjustable means is constructed of a conductive material, and wherein the termination is created by the adjustable means shorting the microstrip to said grounded conductor.

4. The steerable beam phased array antenna of claim 2 wherein the ajustable mean is one-quarter wavelength wide and is constructed of a conductive material, and wherein the termination is accomplished by placing the adjustable means proximate the microstrip.

5. The steerable beam phased array antenna of claim 1 wherein the adjustable means overlaps each of the transmission paths, wherein repositioning of the adjustable means simultaneously changes the effective length of each transmission path to form and steer the beam from the steerable beam phased array antenna.

6. A steerable beam phased array antenna comprising:

a plurality of antenna elements;

a transmission path associated with each antenna element, said transmission path being adapted to carry an incident signal; and adjustable means for changing the length of each transmission path by establishing the termination point of each transmission path so as to form a reflected signal at the termination point, wherein said reflected signal is time delayed with respect to said incident signal as determined by the location of the termination point, and wherein said adjustable means includes a pivot point at the center thereof and overlaps each of said transmission paths, wherein rotation of said adjustable means about said pivot point simultaneously changes the effective length of each transmission path to steer the phased array antenna.

7. The steerable beam phased array antenna of claim 1 wherein the transmission path associated with each antenna element includes:

coupler means having an input terminal responsive to a signal on the transmission path for coupling the signal to two path segments, wherein the signal on each path segment has a predetermined amplitude and phase characteristic with respect to the signal on the other path segment;

wherein the adjustable means shorts the path segments to ground to produce a reflected wave on each path segment;

wherein said reflected wave on each path segment is reflected back to said coupler means, wherein said coupler means combines said reflected signals to produce a combined reflected signal emanating from an output terminal thereof, and wherein said combined reflected signal is time-delayed and has a predetermined amplitude and phase characteristic with respect to the signal input to each transmission path to achieve forming and steering of the beam from the steerable beam phased array antenna.

8. The steerable phased array antenna of claim 1 wherein the termination is a short circuit.

9. The steerable phased array antenna of claim 1 wherein the termination is an open circuit.

10. A steerable beam phased array antenna comprising:

a plurality of antenna elements;

a transmission path associated with each antenna element, said transmission path being adapted to carry an incident signal;

means for directing said incident signal to a termination point on each transmission path;

means for redirecting a reflected signal from said termination point onto said transmission path wherein said reflected signal is time delayed with respect to said incident signal as determined by the location of the termination point, and adjustable means for changing the termination point for each transmission path to change the effective length thereof to change the time delay of said reflected signal with respect to said incident signal to achieve forming and steering of the steerable beam phased array antenna.

11. The steerable beam phased array antenna of claim 10 wherein the termination point is an open circuit.

12. The steerable beam phased array antenna of claim 10 wherein the termination point is a short circuit.

13. A steerable beam phased array antenna comprising:

a plurality of antenna elements;

a transmission path associated with each antenna element, for carrying an antenna signal;

means responsive to said antenna signal associated with each antenna element for producing first and second incident signals having a predetermined amplitude and phase characteristic with respect to said antenna signal;

first and second path segments for carrying said first and second incident signals, respectively;

adjustable means for shorting said first and second path segments to change the effective lengths thereof and to produce first and second reflected signals at the short on said first and second path sesgments; respectively; and means for combining said first and second reflected signals to form an output signal having a predetermined amplitude and phase characteristic with respect to said antenna signal, wherein said output signal is time delayed with respect to said antenna signal for forming and steering said steerable beam phased array antenna.

14. The steerable beam phased array antenna of claim 13 wherein the means for producing the first and the second incident signals and the output signal includes a hybrid directional coupler.

15. A steerable beam phased array antenna comprising;

a plurality of antenna elements;

a transmission path associated with each antenna element, for carrying an antenna signal;

means respective to said antenna signal associated with each antenna element for producing an incident signal having a predetermined amplitude and phase characteristic with respect to said antenna signal;

a path segment for carrying said incident signal;

adjustable means for shorting said path segment to ground to change the effective length thereof and to produce a reflected signal on said path segment, said reflected signal having a predetermined amplitude and phase characteristic with respect to said incident signal;

means responsive to said reflected signal to form an output signal having a predetermined amplitude and phase characteristic with respect to said antenna signal, wherein said output signal is time delayed with respect to said antenna signal for forming and steering said steerable beam phased array antenna.

16. The steerable beam phased array antenna of claim 15 wherein the means for producing the incident signal and the output signal includes a microwave circulator.

* * * * *